US005642746A

United States Patent [19]

Sayce

[11] Patent Number: 5,642,746

[45] Date of Patent: Jul. 1, 1997

[54] FLUSHING SYSTEM FOR A HOLDING TANK OF A RECREATIONAL VEHICLE

[76] Inventor: Norman C. Sayce, 5151 4th St. N., Lot 337, St. Petersburg, Fla. 33703

[21] Appl. No.: 606,395

[22] Filed: Feb. 23, 1996

[51] Int. Cl.[6] ..... B08B 3/04; B08B 3/02

[52] U.S. Cl. ..... 134/168 R

[58] Field of Search ..... 134/102.2, 166 R, 134/167 R, 168 R, 169 R, 169 A

[56] References Cited

U.S. PATENT DOCUMENTS

| | | | |
|---|---|---|---|
| 3,536,081 | 10/1970 | Riess | 134/169 R X |
| 3,719,191 | 3/1973 | Zimmerly | 134/168 R X |
| 4,527,295 | 7/1985 | Lacore | 4/321 |
| 4,550,453 | 11/1985 | Norman | 134/166 R X |
| 4,667,351 | 5/1987 | Williams | 134/166 R X |
| 4,868,932 | 9/1989 | Thoma et al. | 134/169 R X |
| 5,524,655 | 6/1996 | Powers et al. | 134/168 R X |

*Primary Examiner*—Philip R. Coe
*Attorney, Agent, or Firm*—Harold D. Shall

[57] ABSTRACT

A flushing system for a recreational vehicle grey water holding tank including a water supply line having a upright air containing line with a closed outer end and with its inner end confluent with the supply line, an on-off valve downstream of the air containing line and a one way valve in the supply line. The inner end of the supply line extending into the tank confluently connected to an upright pipe with a spray nozzle on the top end thereof.

4 Claims, 2 Drawing Sheets

FLUSHING SYSTEM FOR A HOLDING TANK OF A RECREATIONAL VEHICLE

BACKGROUND OF THE INVENTION

1. FIELD OF THE INVENTION

This invention relates to a device for flushing and thereby cleaning the grey water holding tanks of recreational vehicles.

2. DESCRIPTION OF PRIOR ART

Prior art devices include systems such as shown in U.S. Pat. Nos. 4,868,932 and 4,527,295 wherein water, at incoming line pressure, is sprayed into the drained tank to thereby dislodge foreign material which is then drained from the tank. However, frequently this foreign material is firmly lodged within the tank and the prior art sprays are not sufficient to properly clean the tank.

SUMMARY OF THE INVENTION

It is an object of this invention to provide a device which furnishes a spray of cleaning water within a holding tank for cleaning the tank.

It is a further object of this invention to provide such a spraying device which includes means in the system for augmenting the incoming water line pressure to thereby provide a strong augmented flow of cleaning water to the tank.

It is yet another object of this invention to provide such a device which includes a "water hammer" structure.

It is yet another object of this invention to provide such a device which includes directional control means so that cleaning water may only empty into the tank while not being able to flow back and contaminate the water source.

Further and other objects of this invention will become apparent from a review of the following drawings, specifications and claims.

BRIEF DESCRIPTION OF THE PREFERRED EMBODIMENTS

DETAILED DESCRIPTION OF THE PREFERRED EMBODIMENT

Figure 1:
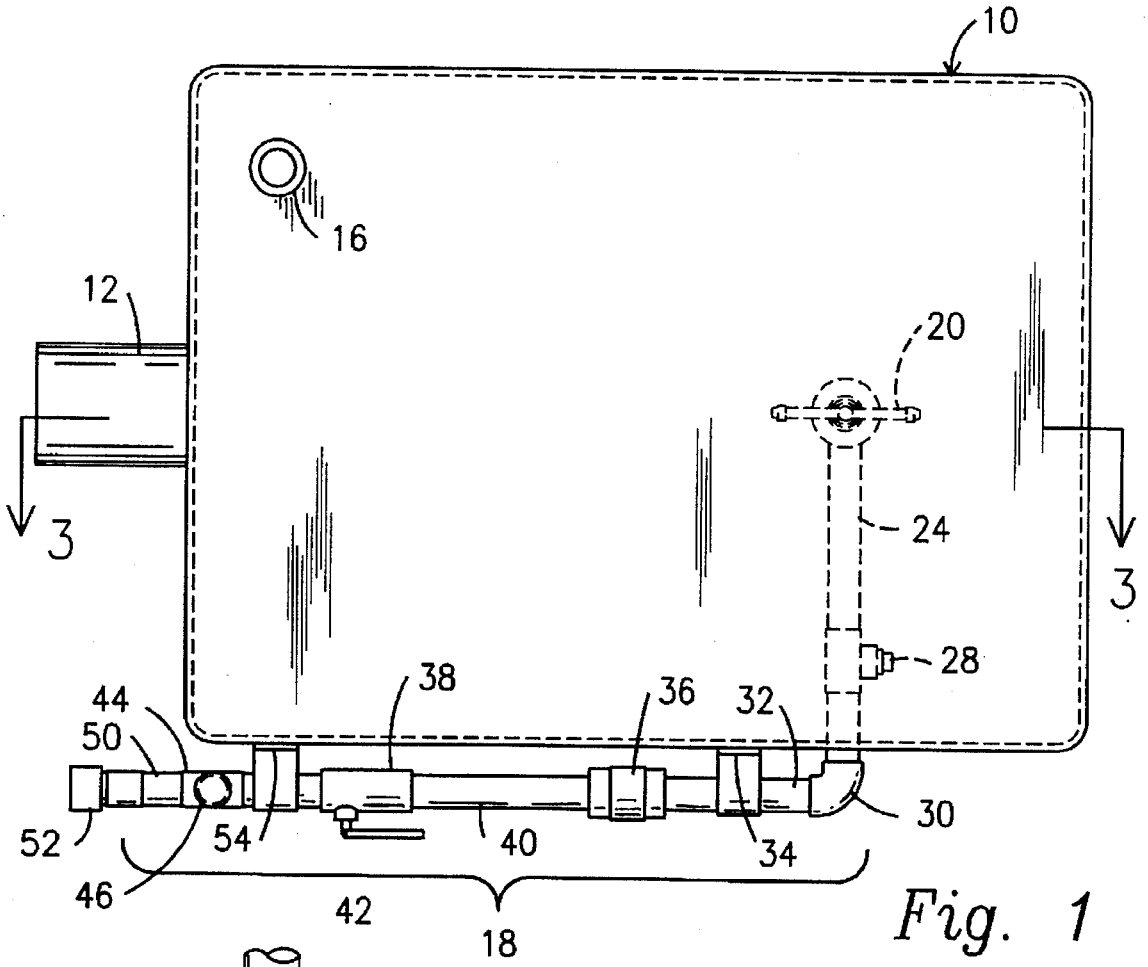
FIG. 1 is a plan view of a holding tank including the flushing device of this invention.
Figure 2:
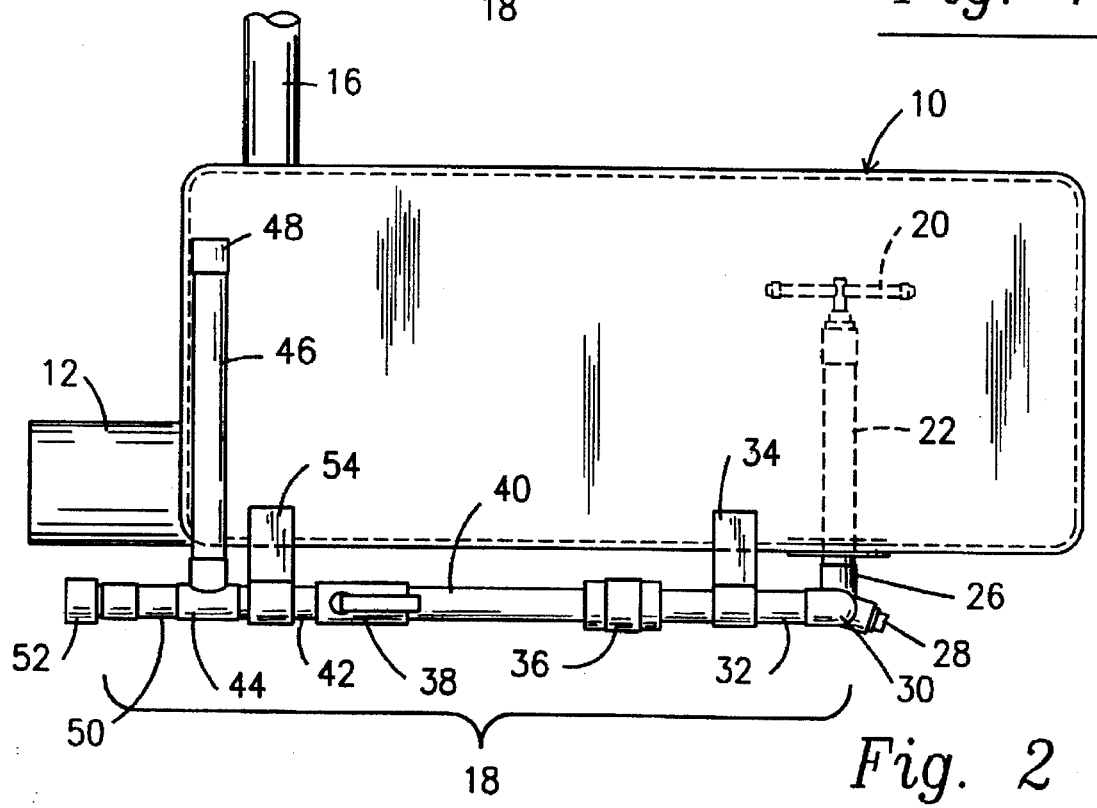
FIG. 2 is a side elevational view of the holding tank of FIG. 1.
Figure 3:
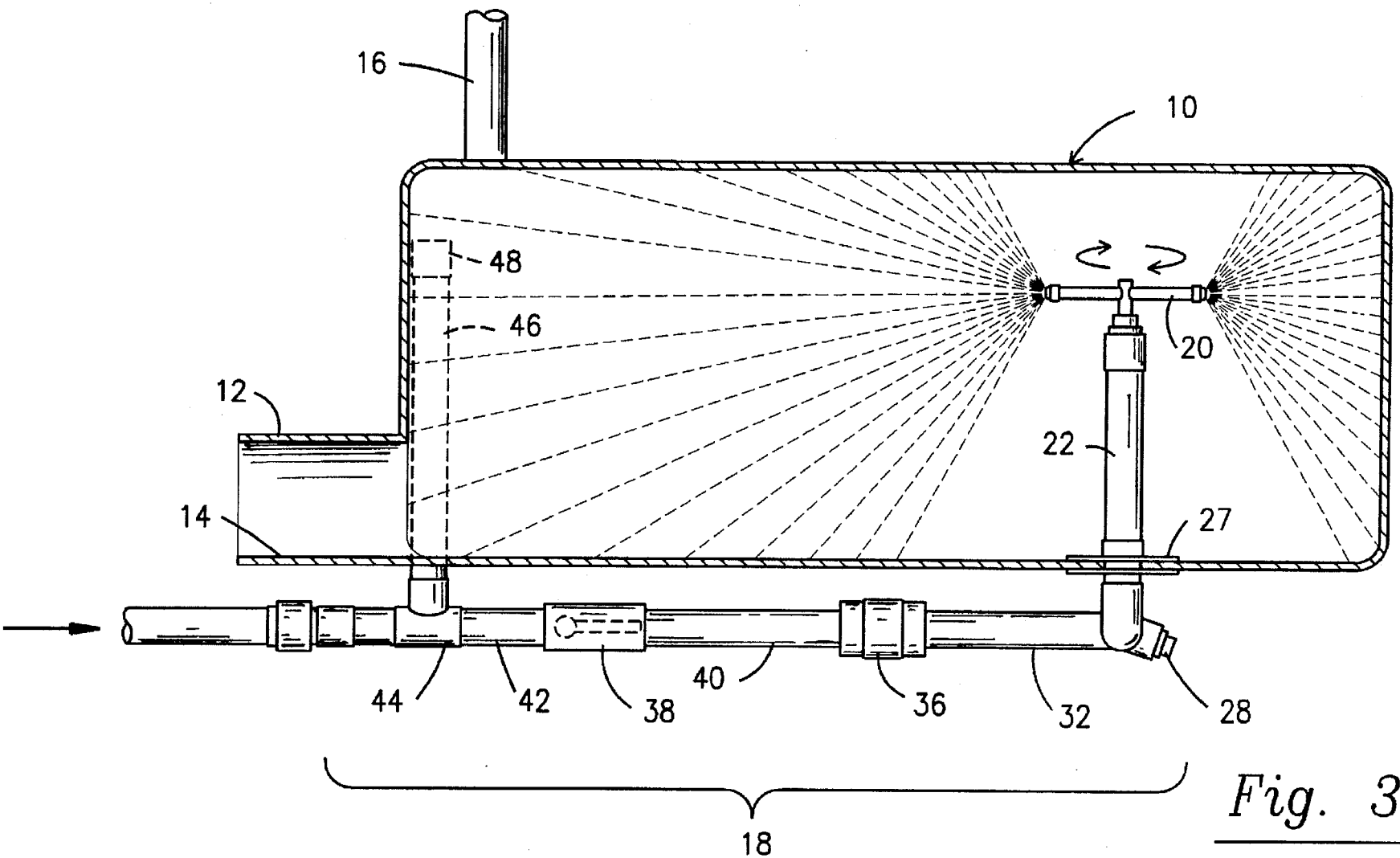
FIG. 3 is a view taken along the lines 3—3 in FIG. 1.

Referring now to the drawings, a grey water holding tank is shown at 10 and has a conventional waste discharge pipe 12 formed integrally therewith which has a discharge opening 14 therein. The pipe 12 is conventionally connected to the sewer system (not shown) of the facility at which the recreational vehicle is parked. A grey water drain line 16 from the vehicle's sinks and showers is connected to the tank 10 and drains the effluent from the sinks and showers into the tank 10. When the tank 10 is full, as indicated on the gauge in the vehicle, the tank can be emptied into the sewer system. In some systems, when the vehicle is connected to a sewer system, the system can continuously drain the tank.

A system shown generally at 18 is provided to clean the tank 10. More particularly, a rotating spray head 20 is rotatably mounted on top of a standpipe 22 which in turn is confluently connected to a laterally extending line 24 by an "L" shaped connector 26. A flange plate 27 allows the line 24 to extend therethrough while sealingly receiving the same, with the plate being sealingly secured about an opening in the bottom of the tank 10. The line 24 has a drain plug 28 therein, which plug can be removed in the event the line needs cleaning. An "L" connector 30 connects the line 24 to an outbound directed pipe 32 which is supported to the tank 10 by a brace 34 and is connected to at its outbound end to a one way flow directing valve 36. The valve 36 will allow fluid to flow therein toward the spray head 20, but will not allow fluid to flow therethrough in the opposite direction; this is a conventional, commercially available valve.

An on-off valve 38 is confluently connected by a line 40 to the valve 36 and the upstream side of the valve 38 is connected by a line 42 to a "T" shaped connector 44. The valve 38 is shown as a hand operated valve, but it will be apparent that a power operated on-off valve can readily be substituted. The connector 44 is connected to an upright line 46 having a capped (enclosed) outer end 48 and is also connected by a line 50 to a female hose connector 52. A bracket 54 supportingly connects the line 42 to the tank 10.

With the tank 10 drained or substantially drained, a water line (not shown) can be attached to the connector 52 and the water supply directed to the clean out system 18. Opening the valve 38 will allow water to flow to the spray head 20 and into the tank 10. Upon momentarily closing the water valve 38, the water in line 50 will compress the air in the upright line 46 whereby upon opening the valve 38 it will allow water to again pass therethrough at a pressure which is pulsedly augmented by the compressed air in line 46 in the manner of a "water hammer". Repeatedly opening and closing the valve 38 will cause bursts of high pressure water to be discharged out of the spray head 20 to thereby clean the tank 10. The system 18 can be originally installed when the tank is first made or can be retrofit onto existing tanks.

While only a single embodiment of this invention has been shown and described, it is apparent that many changes can be made therein without departing from the scope of this invention as defined by the following claims.

What is claimed is:

1. A flushing system for a holding tank of a recreational vehicle, which tank is connected by a drain to a sewer system, comprising in combination, a) a holding tank for receiving effluent from the recreational vehicle's equipment, and having a bottom, top and sides, b) a drain line for said holding tank, c) a flushing system carried by said tank including, 1) a small pipe sealingly entering said tank and having a spray head on the outer end thereof, 2) a supply line connected to said small pipe and having a one way valve therein allowing fluid to flow only toward said small pipe, 3) said supply line also having an on-off valve therein and an air entrapped line confluently connected thereto with said entrapment line having a sealed outer end and extending from said supply line and connected means on the upstream end of said supply line for connecting to a source of water, d) and means securing said flushing system to said tank.

2. A system according to a claim 1 wherein said pipe entering said tank enters from the bottom of said tank and extends upwardly thereinto and said spray head is located on the top of said pipe.

3. A system according to claim 2 wherein said spray head is a rotating spray head.

4. A system according to claim 1 wherein said spray head is a rotating spray head.

* * * * *